United States Patent [19]

Cuccio

[11] Patent Number: 4,546,688

[45] Date of Patent: Oct. 15, 1985

[54] HOLDER FOR MUSICAL INSTRUMENTS

[76] Inventor: Anthony Cuccio, 156 S. Arnaz, Ojai, Calif. 93023

[21] Appl. No.: 561,541

[22] Filed: Dec. 14, 1983

[51] Int. Cl.[4] ..... G10G 5/00

[52] U.S. Cl. ..... 84/327; 84/329; 84/453; 248/205.1; 248/224.3; 248/311.3

[58] Field of Search ..... 84/327, 329, 453; 248/205.1, 224.3, 311.3, 313

[56] References Cited

U.S. PATENT DOCUMENTS 3,664,224 5/1972 Campagna ..... 84/327
3,765,633 10/1973 Caudill ..... 248/229
4,176,580 12/1979 Gallegos ..... 84/327
4,467,693 8/1984 Nasfell ..... 84/329

FOREIGN PATENT DOCUMENTS 2753518 7/1979 Fed. Rep. of Germany ..... 84/327

*Primary Examiner*—Lawrence R. Franklin

[57] ABSTRACT

A holder for a stringed instrument such as a guitar comprises an annular cradle and a male prong attached thereto. The prong is sized and shaped to be received in a conventional electrical receptacle jack of the type found on amplifier/speaker units and is constructed of electrically insulating material. An attachment for supporting a drinking glass or cup is also provided.

6 Claims, 9 Drawing Figures

FIG. 1
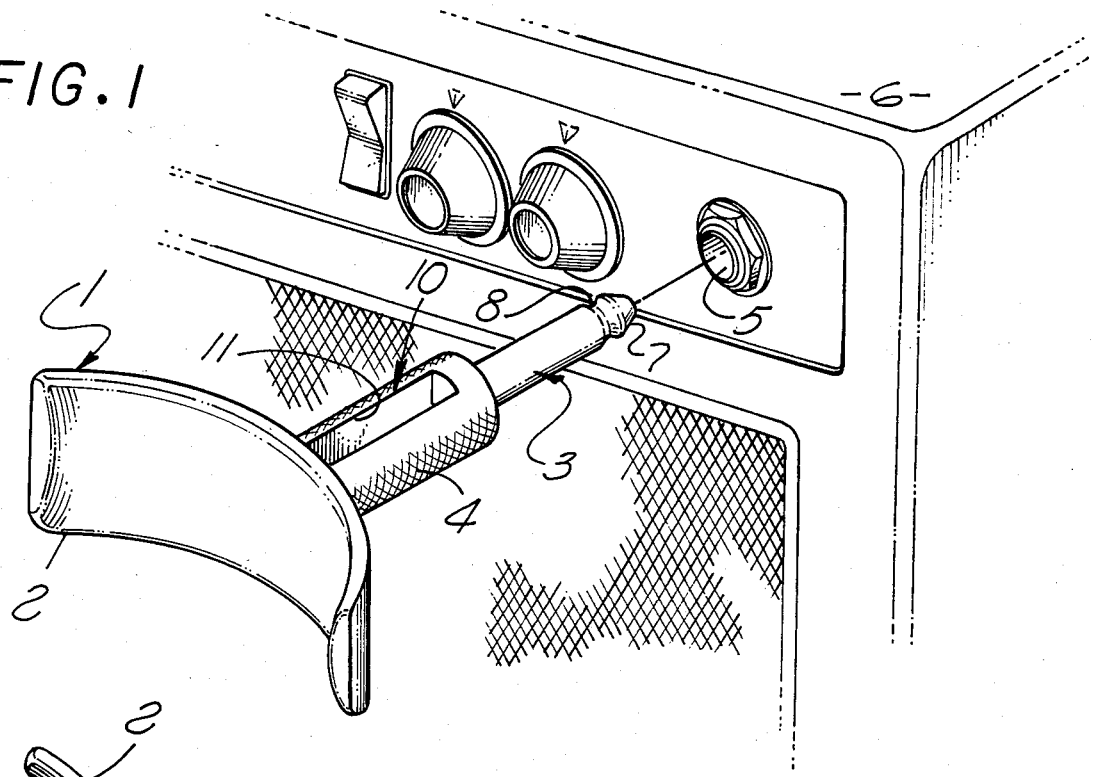
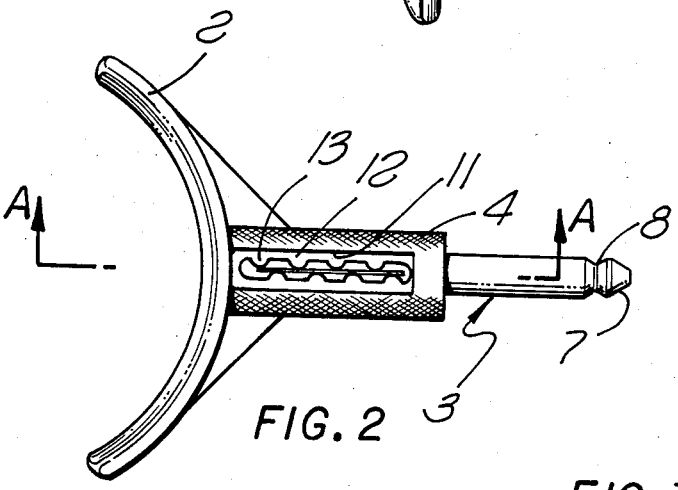
FIG. 2
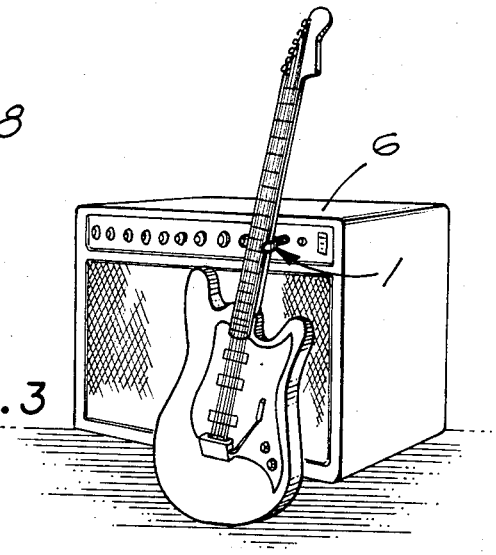
FIG. 3
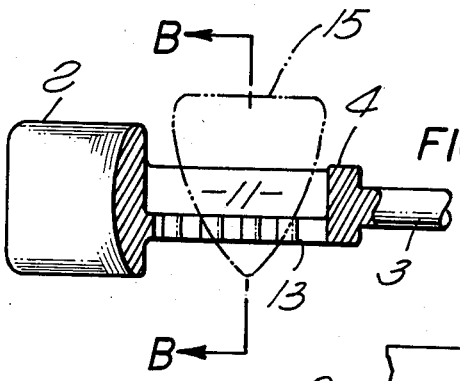
FIG. 2A
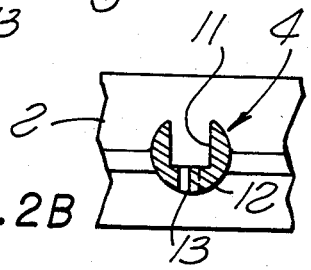
FIG. 2B
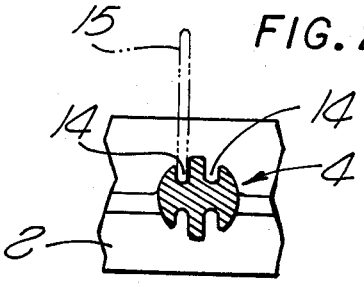
FIG. 2C

HOLDER FOR MUSICAL INSTRUMENTS

BRIEF SUMMARY OF THE INVENTION

It is the usual practice of musicians who play stringed musical instruments such as guitars with electrical amplification, particularly in night clubs, to stand their musical instrument of the floor during periods of non-use and lean it against a musical amplifier/speaker unit. Since there is only a minimal point engagement between the neck of the guitar or other musical instrument and the edge of the amplifier box, these musical instruments are frequently knocked to the floor and damaged particularly during movement of the musicians to and from their locations of performance.

Electrical amplifier/speaker units typically have unused female jack receptacles on the front of the units located near the top thereof. It has been discovered that such receptacles can be conveniently used for the purpose of receiving a holder accessory. The present invention provides such a holder having a cradle which receives the guitar neck and which is attached to a gripping shank having a male jack prong at the end thereof which can conveniently be inserted into the receptacle unit in the speaker thus providing a simple, convenient and inexpensive means of preventing damage to the musical instrument.

The device may also be easily provided with a groove or slotted arrangement for holding guitar picks and can also be easily adapted to receive a basket for holding a drinking glass.

BRIEF DESCRIPTION OF DRAWINGS

FIG. 1 is a perspective view of the holder; FIG. 2 is a plan view of the holder;

FIG. 2A is a partial cross section along line A—A of FIG. 2;

FIG. 2B is a cross section along line B—B of FIG. 2A;

FIG. 2C is a cross section similar to FIG. 2B of an alternative embodiment;

FIG. 3 is a perspective view of the holder in place on an amplifier/speaker unit with an instrument received thereon.

DETAILED DESCRIPTION

Figure 4:
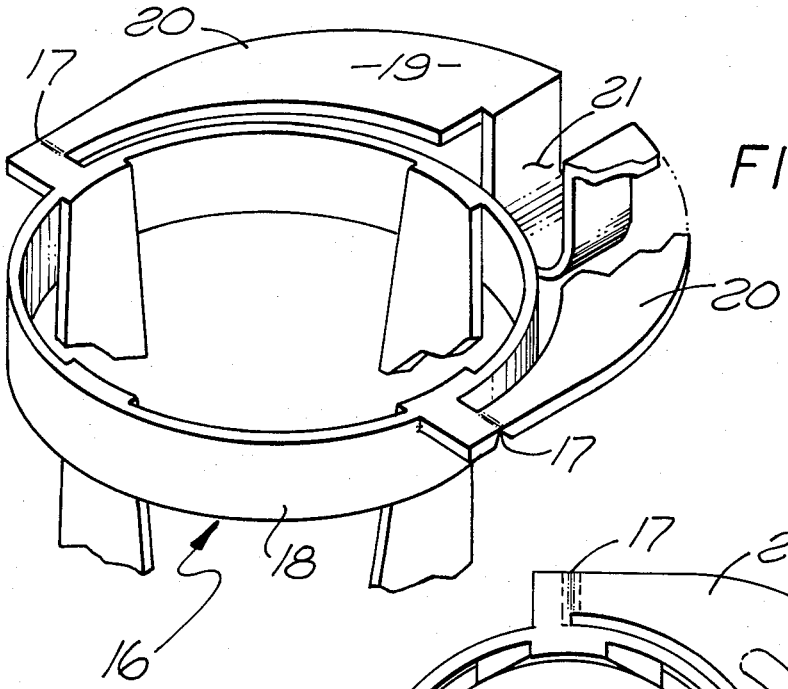
FIG. 4 is a partial perspective view of a basket accessory for holding a drinking glass or cup.

The musical instrument holder comprises a cradle 1 having a pair of opposed arms 2 preferably of arcuate configuration. Arms 2 are each provided with rounded or otherwise smooth edges and corners for receiving the neck of a stringed musical instrument such as a guitar. Affixed to cradle 1 is a prong 3 having a knurled or otherwise roughened gripping shank 4 for inserting the prong 3 into or withdrawing the prong 3 from a receptacle jack 5 on an amplifier unit 6.

Prong 3 is of standard size and configuration to mate with receptacle jack 5. Accordingly, prong 3 is preferably of cylindrical configuration and has a conical head 7 to facilitate insertion and a recess 8 circumscribing the prong 3 near head 7 for releasably retaining the prong 3 in receptacle jack 5.

Preferably the holder is constructed entirely of hard plastic or other insulating material so as to prevent electrical interference in the circuitry of amplifier unit 6 and/or shock to the user. A cushioning pad (not shown) may be provided in the arcuate cradle arms 2 to avoid scratching the neck of the stringed instrument.

It has been found advantageous to incorporate a a guitar pick holder 10 into shank 4. This is accomplished by providing a rectangular cutout 11 in shank 4 and by providing a pair of opposed gripping members 12 best seen in FIGS. 2, 2A and 2B longitudinally extending in cutout 11, said gripping members 12 having teeth 13 thereon for engaging a pick as shown in phantom lines in FIG. 2A. When the holder is made of plastic material, the inherent resiliency of the plastic provides just enough gripping force for teeth 13 to releasably hold the stored pick 15.

FIG. 2C shows an alternate cross section of shank 4 in which shank 4 is provided with longitudinal grooves 14 sized to grippingly receive the edges or point of a guitar pick 15.

It will be appreciated that a simple and inexpensive holder for a guitar or the like has been provided which employs a readily available receptacle jack for a previously unheard of use.

The holder cradle 1 can easily be adapted to other uses such, for example as holding a drinking glass in which instance a basket 16 for holding the glass can be attached to the cradle 1 by suitable pivot hinges or pins.

FIG. 4 shows one such presently preferred arrangement for holding a drinking glass or cup comprising a basket 16 suspended from a pair of hinges 17 provided at diametrically opposite points across upper basket rim 18. An arcuate saddle plate 19 having a cantilevered pair of supporting arms 20 joined to each other by a U-shape saddle 21 intermediate the ends of the arms 20 supports basket 16 from the ends of arms 20 at hinges 17.

Figure 5:
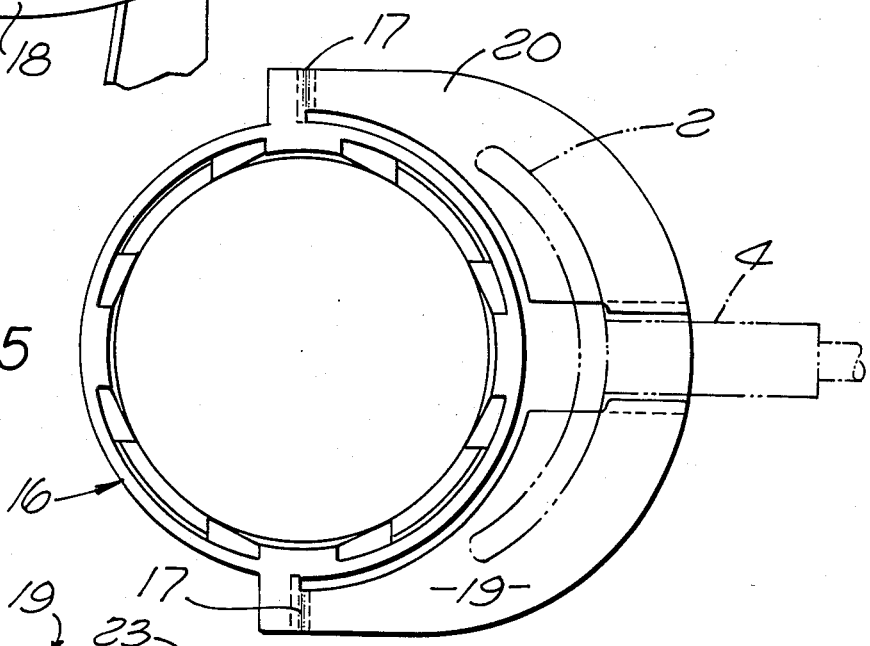
FIG. 5 is a plan view of the basket accessory of FIG. 4 attached to the holder.
Figure 6:
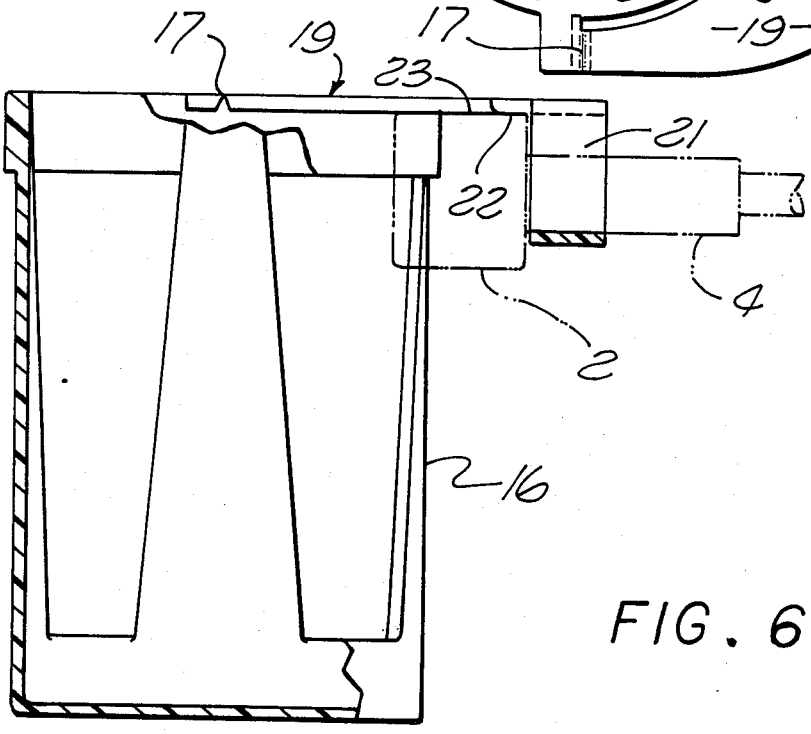
FIG. 6 is an elevation, partly is cross section, of the basket accessory.

As seen in FIGS. 5 and 6 the lower surfaces 22 of plate arms 20 rest upon the upper supporting edge 23 of cradle arms 2 with the shank 4 of cradle 1 received in saddle 21 such that the basket 16 is supported from saddle plate arms 20 by the hinges 17 at the ends thereof. The preferred embodiment of basket and saddle plate will be constructed entirely of plastic such that hinges 17 can be in the form of grooves across the ends of arms 20 to form a living hinge of weakened plastic material. It will be appreciated that the basket 16 and saddle plate 19 can be supported on or removed from arcuate cradle 1 simply by pivoting basket 16 about hinges 17 from the ordinary vertical position of basket 16 shown in FIG. 4 to a generally horizontal position so as to allow clearance between arcuate cradle arms 2 and basket 16.

Although the invention has been described in detail by way of illustration and example for purposes of clarity of understanding, it will be understood that certain changes and modifications may be practiced within the scope of the appended claims.

I claim:

1. A holder for a musical instrument comprising a cradle for receiving the neck of a musical instrument and a male jack prong adapted to be received in a standard female jack receptacle of the type found on electrical speaker/amplifier units, said cradle being affixed to said male jack prong, a gripping shank interposed between said cradle and said prong, and means in said shank for holding picks for a stringed musical instrument.

2. A holder according to claim 1 wherein said male jack prong is constructed of electrically insulating material.

3. A holder according to claim 1 wherein said cradle has a padded portion for receiving said neck of a musical instrument.

4. A holder according to claim 1 further comprising a receptacle for receiving a drinking container suspended from said cradle.

5. A holder according to claim 4 wherein said receptacle is a basket and basket support detachably connectable with said cradle.

6. A holder according to claim 5 wherein said cradle has a pair of arcuate arms of substantially equal length, said shank is diposed intermediate the ends of said arms, and said basket support has a saddle portion engageable with said shank and basket support arms engageable with said cradle arms.

* * * * *